United States Patent [19]

Ohta et al.

[11] Patent Number: 4,666,743

[45] Date of Patent: May 19, 1987

[54] METHOD FOR MANUFACTURING A DECORATIVE SHEET

[75] Inventors: Kazutoshi Ohta, Nagoya; Kenichi Takemoto, Ichinomiya; Katsumi Makino, Inazawa, all of Japan

[73] Assignee: Mitsubishi Denki Kabushiki Kaisha, Tokyo, Japan

[21] Appl. No.: 797,812

[22] Filed: Nov. 13, 1985

[30] Foreign Application Priority Data

| | | | |
|---|---|---|---|
| Nov. 13, 1984 | [JP] | Japan | 59-239200 |
| Dec. 14, 1984 | [JP] | Japan | 59-264090 |
| Jan. 22, 1985 | [JP] | Japan | 60-9394 |
| Jan. 22, 1985 | [JP] | Japan | 60-9395 |

[51] Int. Cl.[4] ..... B05D 1/10

[52] U.S. Cl. ..... 427/265; 427/287; 427/282; 427/423

[58] Field of Search ..... 427/423, 34, 265, 282, 427/287

[56] References Cited

U.S. PATENT DOCUMENTS

| | | | |
|---|---|---|---|
| 2,908,068 | 10/1959 | Biel et al. | 427/423 X |
| 4,031,268 | 6/1977 | Fairbairn | 427/423 X |
| 4,032,672 | 6/1977 | McCormick | 427/423 X |
| 4,160,048 | 7/1979 | Jaeger | 427/423 X |
| 4,263,341 | 4/1981 | Martyniak | 427/423 X |
| 4,299,859 | 11/1981 | Romine | 427/423 X |
| 4,535,022 | 8/1985 | Kato | 427/423 X |

OTHER PUBLICATIONS

Catalogue of Metco Inc.

Articles about flame-spraying from Mikkei Newspaper published on Oct. 16, 1985.

Excerpts of Mechanical Engineering Review (Fifth Edition) published by Mechanical Society of Japan on Jun. 15, 1973 in Japan.

*Primary Examiner*—Shrive P. Beck

*Attorney, Agent, or Firm*—Wenderoth, Lind & Ponack

[57] ABSTRACT

A method for manufacturing a decorative sheet from a metallic sheet comprises the steps of flame-spraying a coating material onto the surface of a metallic sheet to form a flame-sprayed layer thereon, and roughening the surface of the flame-sprayed layer. The surface of the metallic sheet may be etched in the shape of some pattern to form the flame-sprayed layer, and may be covered with at least one mask having a pattern opening which extends through the mask and has a pattern so as to form the pattern on the surface of the metallic sheet by flame-spraying of the coating material through the pattern opening of the mask.

11 Claims, 18 Drawing Figures

METHOD FOR MANUFACTURING A DECORATIVE SHEET

BACKGROUND OF THE INVENTION

This invention relates to a method for manufacturing a decorative sheet having a pattern on the surface thereof.

Conventionally, plates made of stainless steel etc. have been used as base plates for decorative sheets. Etching is one of the methods for making recessed and projected patterns on the surface of regular carbon steel plates. In an etching process, grooves whose depths are about 0.1 to 0.2 mm are formed on the surface of the steel plate by chemical corrosion, thereby forming a decorative plate having a predetermined pattern.

However, such conventional decorative sheets have a problem in that the stainless steel is expensive.

Decorative sheets are sometimes used in hoistway doors, car doors etc. of an elevator. Such decorative sheets such as the decorative sheet disclosed in Japanese Laid-Open Utility Model Publication No. 59-54478 are made by applying a coating material onto the bottom of an etched groove of a sheet. FIGS. 1 and 2 show such a decorative sheet. In these figures, a decorative sheet comprises a metallic plate 101 forming a hoistway door, and grooves 102 are formed on the surface of the metallic plate 101 by etching. The bottom of each groove 102 is coated by a transparent or opaque coating material 103. Grooves 104 are also formed on the surface of the sheet 101 by etching and are narrower than the widths of the grooves 102. The bottom of each groove 104 is coated by a similar coating material 105. Thus the decorative sheet is made by forming grooves 102, 104 and coating materials 103, 105.

However, such a conventional method for manufacturing a decorative sheet has the disadvantage that although various color tones can be expressed by paint, it is difficult to obtain a solid appearance only by the paint.

Furthermore, the method using etching has certain disadvantages in that it is necessary to prepare a chemical liquid for etching and it often takes a long time to manufacture a decorative sheet since materials are collected within a certain period and thereafter etched together with each other in the same liquid and such a period for collecting materials is often long, and that it also tends to generate pollution during the treatment of the sump solution, the complete treatment of which is also very expensive.

Furthermore, it is necessary to use an expensive decorative base plate made of aluminum and stainless steel for example, and the appearance of high quality as obtained from the combination of a plurality of metals cannot be obtained.

In another method for manufacturing a decorative sheet, an embossing process has been used in which a metallic plate is pressed by a roller provided with a projected pattern to form a pattern on the surface of the plate.

However, the embossing method has other disadvantages in that the depth of the pattern is shallow and it is not suitable for especially a thick metallic plate, and the edge portions of the pattern are rounded and sharp edges are difficult to form.

To overcome the above disadvantages, an object of the present invention is to provide a method for manufacturing a decorative sheet in which the sheet has a solid appearance of high quality and the edge portions of a pattern on the sheet can be formed to be clear-cut and distinct.

Another object of the present invention is to provide a method for manufacturing a decorative sheet in which the decorative sheet can be cheaply manufactured and the portions of the sheet formed by the unevenness of the processing thereof do not stand out.

Another object of the present invention is to provide a method for manufacturing a decorative sheet in which a layer formed on the sheet has a volume corresponding to at least the volume of the pattern on the sheet.

Another object of the present invention is to provide a method for manufacturing a decorative sheet in which the decorative sheet has an intricate pattern thereon.

With the above objects in view, the present invention, according to the first embodiment thereof, resides in a method for manufacturing a decorative sheet from a metallic sheet comprising the steps of flame-spraying a coating material onto the surface of the metallic sheet to form a flame-sprayed layer thereon, and roughening the surface of the flame-sprayed layer.

The present invention, according to the second embodiment thereof, resides in a method for manufacturing a decorative sheet from a metallic sheet comprising the steps of etching the surface of the metallic sheet to form an etched pattern therein, and flame-spraying a material different from the material of the metallic sheet only on the etched pattern of the metallic sheet through a mask.

The present invention, according to the third embodiment thereof, resides in a method for manufacturing a decorative sheet from a metallic sheet comprising the steps of selectively flame-spraying a first coating material onto the surface of the metallic sheet through a first mask to form a pattern of a first coating layer, and flame-spraying a second coating material onto at least a portion of the uncoated surface of the metallic sheet which is not coated by the first coating layer through a second mask to form a second pattern of a second coating layer.

BRIEF DESCRIPTION OF THE DRAWINGS

The present invention will now be described with reference to the preferred embodiments thereof in conjunction with the accompanying drawings in which.

DETAILED DESCRIPTION OF THE PREFERRED EMBODIMENTS

Referring now to FIGS. 3 to 7, a plate 6 is preferably a metallic plate made of stainless steel, aluminum, etc. A pattern 6*a* is formed by rectangular recessed portions 6*b* which are aligned with each other on the surface of the plate 6 and formed by an etching process. A mask 7 made of a heat resistant material is a plate having pattern openings 7*a* which extend through the mask 7 and form the same pattern as the pattern 6*a* of the plate 6. A flame-spray gun 8 flame-sprays powder made of a material such as brass, ceramic or glass different from the material of the metallic plate 6. The flame-spray gun 8 is provided with a hopper 1 for receiving the flame-spraying material and a nozzle at the end tip of the gun for flame-spraying the material. Flame-sprayed layers 9*a* are formed within the pattern openings 6*a* of the plate 6 by the flame-spray gun 8.

A decorative sheet according to a first embodiment of the present invention is manufactured by the following steps.

Figure 1:
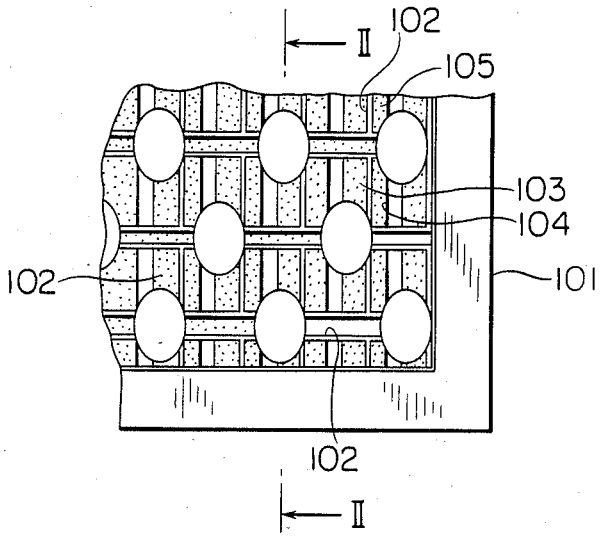
FIG. 1 is a front view of a decorative sheet manufactured according to a conventional manufacturing method.
Figure 2:
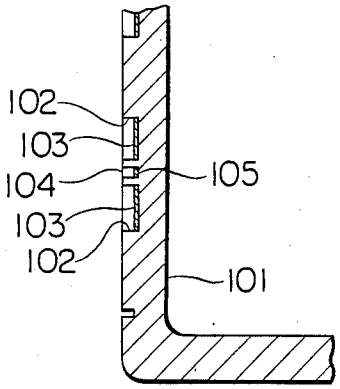
FIG. 2 is a cross-sectional view taken along Line II—II of FIG. 1.
Figure 3:
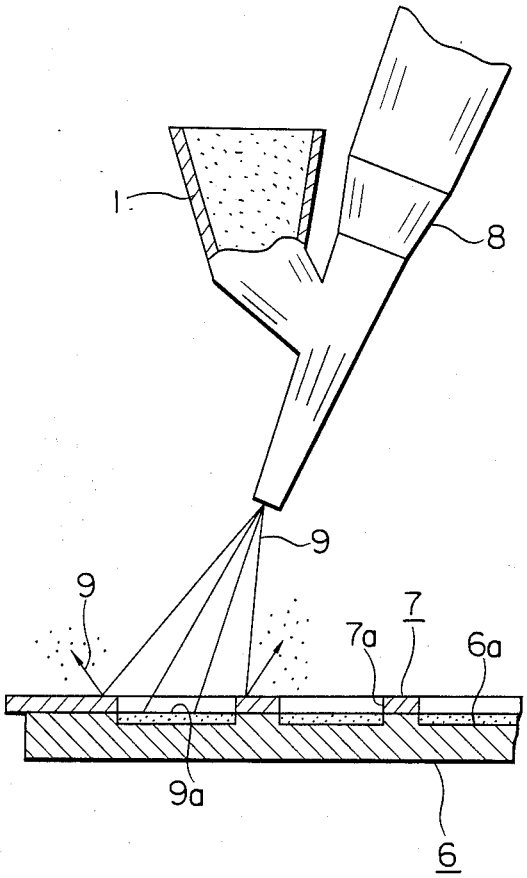
FIG. 3 is a cross-sectional view showing a state in which a material is flame-sprayed onto the surface of a plate through a pattern opening of a mask by a flame-spray gun according to a first embodiment of the present invention.
Figure 4:
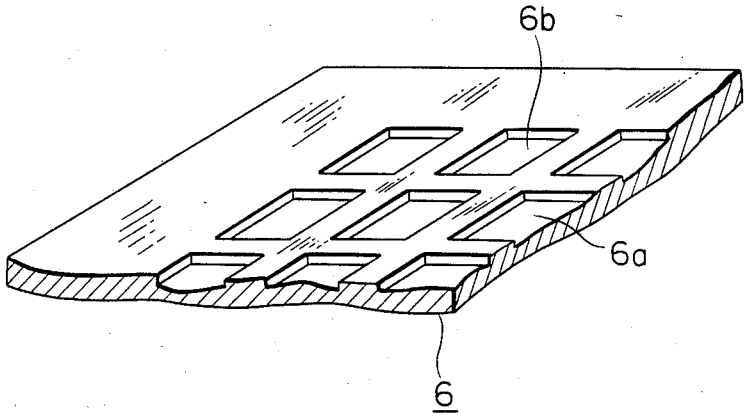
FIG. 4 is a partially broken perspective view of the plate of FIG. 3.
Figure 5:
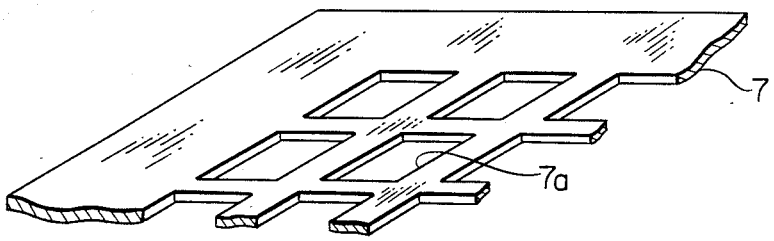
FIG. 5 is a partially broken perspective view of the mask of FIG. 3.
Figure 6:
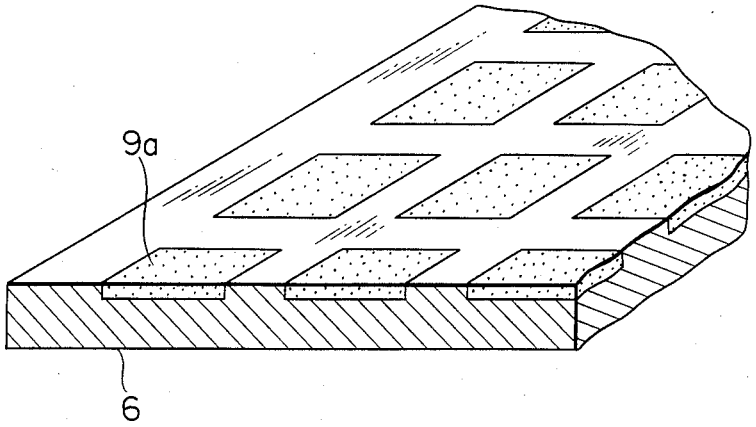
FIG. 6 is a partially broken perspective sectional view showing a state in which the mask has been removed from the plate after the flame-spraying of the flame-sprayed material.
Figure 7:
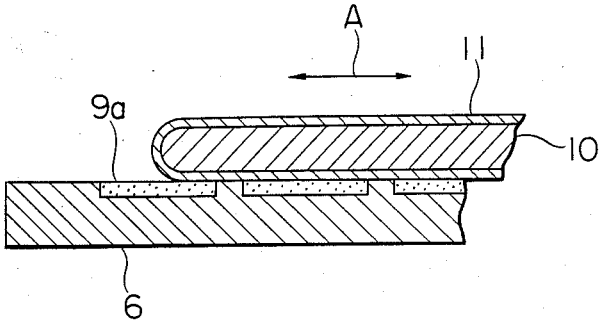
FIG. 7 is a cross-sectional view showing a state in which the surface of the sheet of FIG. 4 is being polished with sandpaper.

As shown in FIG. 4, the surface of the metallic plate 6 is etched to form a predetermined recessed pattern. Then the plate 6 is covered with the mask 7 such that the pattern of the pattern openings 7*a* of the mask 7 corresponds to the recessed pattern 6*a* of the plate 6. Then, as shown in FIG. 3, powder 9 is flame-sprayed by the flame-spray gun 8 into the recessed pattern 6*a* of the plate 6 through the pattern openings 7*a* of the mask 7. Each layer 9*a* of the flame-sprayed material is formed approximately up to the level of the unetched portion of the plate 6. After each layer 9*a* of the flame-sprayed material has been solidified and secured to the plate 6, the mask 7 is removed from the plate 6 as shown in FIG. 6. Thereafter, as shown in FIG. 7, if necessary, the surfaces of the flame-sprayed layers 9*a* may be polished by preferably moving a sandpaper 11 wound around a polishing base member 10 in the direction of the arrow A on the surfaces of flame-sprayed layers 9*a*.

Thus the boundary lines of the pattern 6*a* become distinct and the surfaces of each flame-sprayed layer 9*a* becomes level with the surface of the unetched portion of the metallic plate 6, thereby producing a decorative sheet with a beautiful appearance. Since each flame-sprayed layer 9*a* is not a thin coating but has a quantity corresponding to at least the volume of each recessed portion 6*b*, the sheet has a solid appearance peculiar to solid materials which is different from the effect that can be obtained from the coatings of paint, color developed materials and coloring agents which tend to appear thin. The metallic plate 6 is etched so deeply that the etched portion of the plate 6 will not be exposed even when the surface of each flame-sprayed layer 9*a* is damaged. Furthermore, each flame-sprayed layer 9*a* is firmly secured to the plate 6 since each flame-sprayed layer 9*a* is formed within each recessed portion 6*b* of the plate 6.

The materials of the metallic plate 6 and the flame-sprayed layers 9*a* are not limited to the materials described in the first embodiment, but other different materials may be suitably used. Furthermore, the flame-sprayed layers 9*a* made of a plurality of materials may be formed on the surface of the plate 6.

Figure 10:
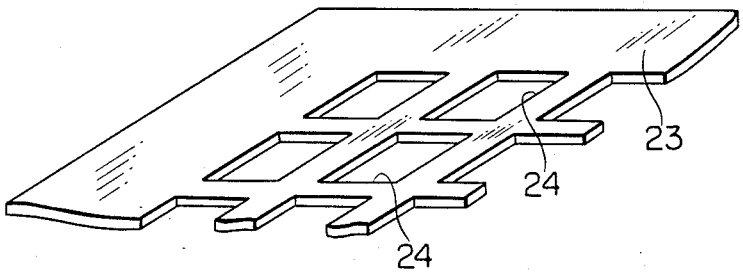
FIG. 10 is a partially broken perspective view of the mask of FIG. 8.

FIGS. 8 to 11 show a second embodiment of the present invention. A pattern 21*a* having rectangular recessed portions 21*b* aligned with each other is formed on the surface of a metallic plate 21 by an etching process. As shown in FIG. 10, a mask 23 made of a heat resistant plate has a plurality of pattern openings 24 extending therethrough and formed in accordance with the recessed portions 21*b* of the metallic plate 21. The metallic plate 21 is covered with the mask 23 such that the pattern of pattern openings 24 of the mask 23 correspond to the pattern of each recessed portions 21*b* of the metallic plate 21.

In order to form a pattern on the surface of the metallic plate 21, it is preferable to dispose a material different from the material of the metallic plate 21 within each recessed portion 21*b* thereof. A flame-spray gun 25 is provided with a hopper 27 for receiving a molten coating material 26 and at the end tip of the gun 25 a nozzle for flame-spraying the molten coating material 26. Such a molten coating material is preferably a mixture of aluminum and brass or a mixture of aluminum and resin.

Figure 8:
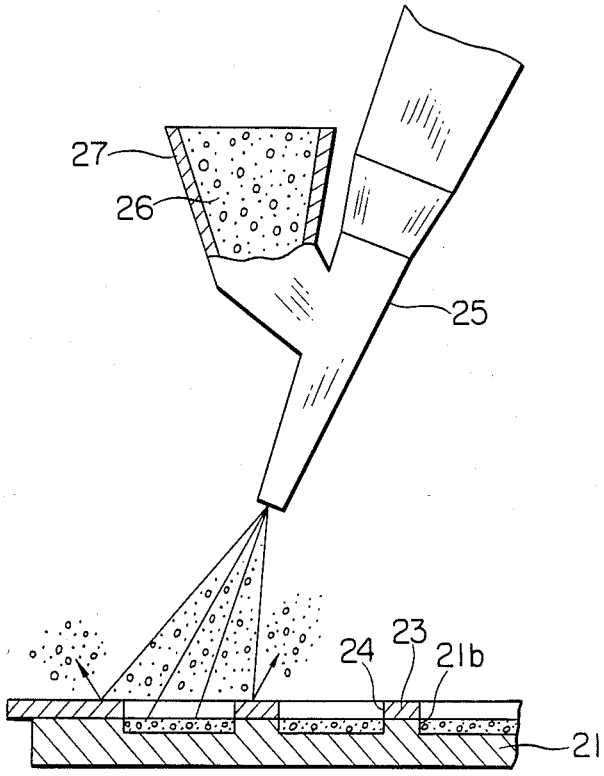
FIG. 8 is a cross-sectional view showing a state in which a material is flame-sprayed onto the surface of a plate through a pattern opening of a mask by a flame-spray gun according to a second embodiment of the present invention.
Figure 9:
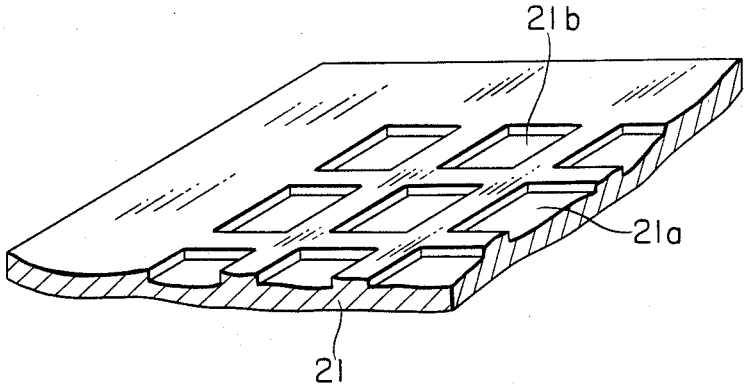
FIG. 9 is a partially broken perspective view of the plate of FIG. 8.
Figure 11:
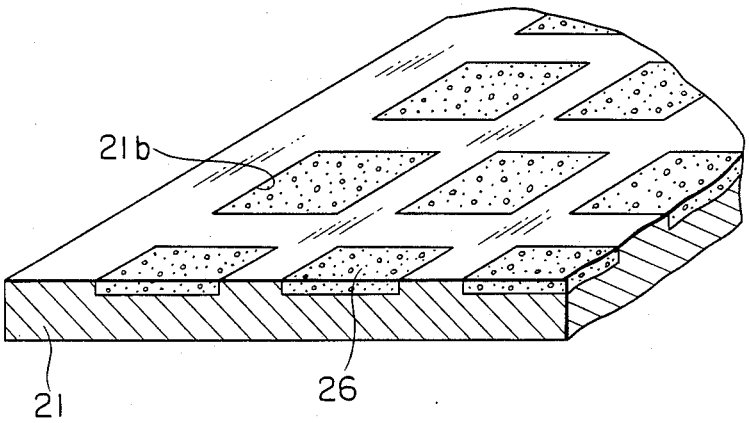
FIG. 11 is a partially broken perspective sectional view of a manufactured decorative sheet.

When a decorative sheet is manufactured according to the second embodiment, the metallic plate 21 is covered with the mask 23 such that the pattern formed by the openings 24 corresponds to the pattern 21*a* formed by the recessed portions 21*b*. Then, as shown in FIG. 8, the molten coating material 26 is flame-sprayed from the nozzle of the flame-spray gun 25 into the recessed portions 21*b* of the metallic plate 21 through the openings 24 of the mask 23. The flame-sprayed coating material solidifies securely to the plate 21, forming a coating layer of the flame-sprayed material in each recessed portion 21*b* of the plate 21. Thereafter the mask 23 is removed from the plate 21. FIG. 11 shows a decorative sheet thus manufactured in which a pattern having an intricate color tone is formed on the surface of the sheet through the metallic plate 21, coating the coating material 26 within the recessed portions 21*b* of the plate 21. Further intricate patterns can be obtained by dyeing and color development of the surface of the sheet.

In the second embodiment, a plurality of molten coating materials are flame-sprayed onto the surface of the metallic plate 21 to form a pattern thereon. Therefore, a decorative sheet having an intricate pattern and high quality can be cheaply manufactured, and such a sheet may be used for a door in an elevator.

Figure 12:
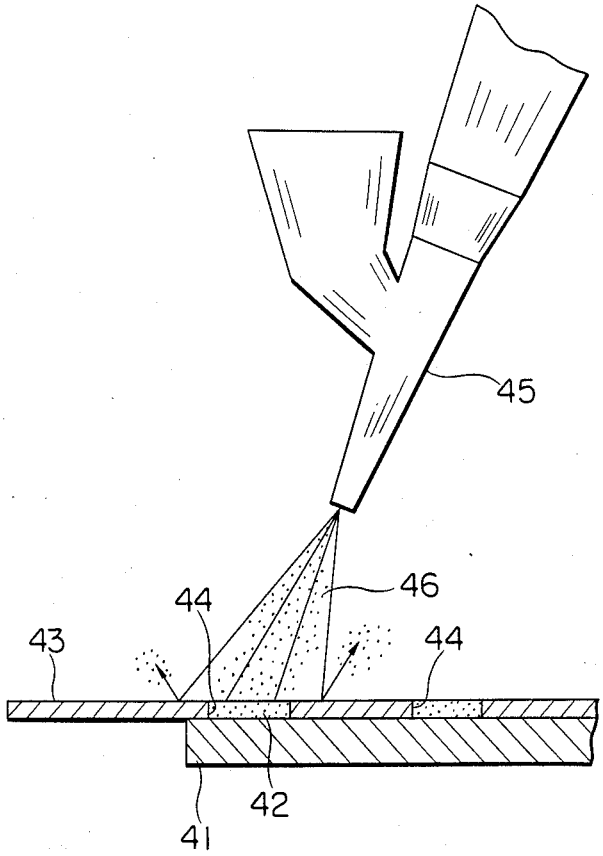
FIG. 12 is a cross-sectional view showing a state in which a first material is flame-sprayed onto the surface of a plate through a pattern opening of a first mask by a flame-spray gun according to a third embodiment of the present invention.

FIGS. 12 to 16 show a third embodiment of the present invention. A first mask 43 is made of a heat resistant material and has openings 44 extending through the first mask 43 and forming a first pattern. As shown in FIG. 12, the surface of a steel plate 41 is covered by the first mask 43. Then a first coating material 46 of stainless steel powder is flame-sprayed onto the surface of the plate 41 through the openings 44 of the first mask 43 by a flame-spray gun 45. When the first coating material 46 is solidified within the openings 44 of the first mask 43, a first coating layer 42 defined by each opening 44 is formed on the surface of the metallic plate 41. Thereafter, the first mask 43 is removed from the plate 41.

Figure 13:
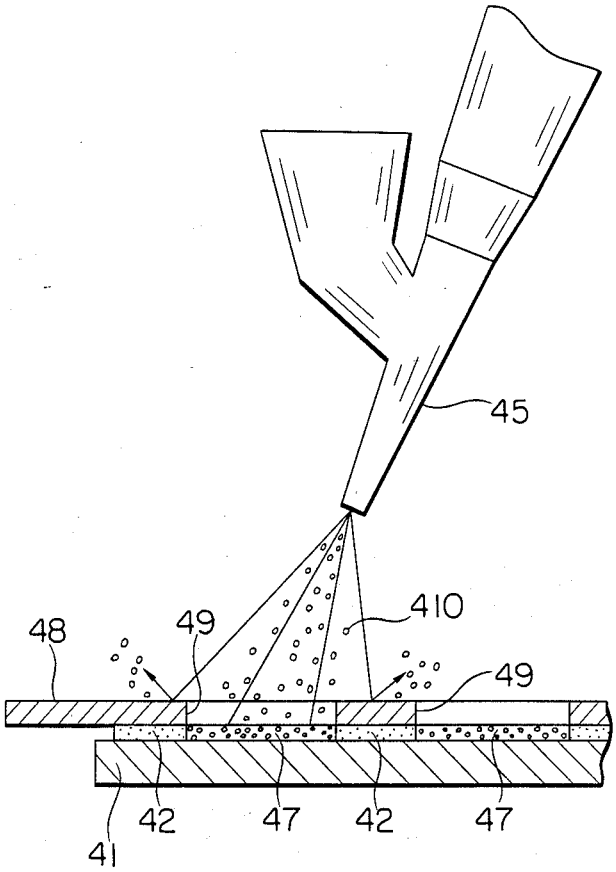
FIG. 13 is a cross-sectional view showing a state in which a second material is being flame-sprayed onto the surface of the plate of FIG. 12 through a pattern opening of a second mask.
Figure 14:
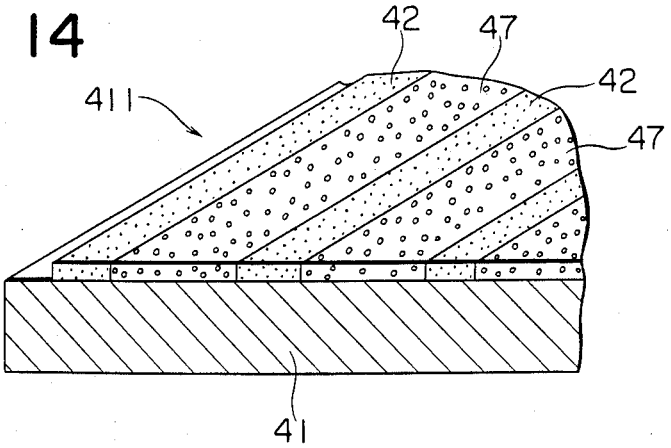
FIG. 14 is a partially broken perspective sectional view of a sheet manufactured by the processings shown in FIGS. 12 and 13.

After each first coating layer 42 has been formed on the metallic plate 41, as shown in FIG. 13, a second mask 48 made of a heat-resistant material is closely disposed on the surface of each first coating layer 42. Namely, the second mask 48 has openings 49 and closely covers the surface of each first coating layer 42 such that the openings 49 are disposed on the uncoated surface of the plate 41 which is not coated by a first coating layer 42. In this state, a second coating material made of brass powder is flame-sprayed onto the surface of the metallic plate 41 through the openings 49 of the second mask 48 by the flame-spray gun 45. After the flame-sprayed material within the openings 49 has solidified, second coating layers 47 are formed between the first coating layers 42 on the surface of the plate 41. FIG. 14 shows a manufactured decorative sheet 411 in which the first and second coating layers 42 and 47 are alternately arranged on the surface of the metallic plate 41.

Although the surface of the plate 41 is coated by two kinds of coating layers as shown in FIG. 14, more than three kinds of coating layers may be formed on the surface of the plate 41, forming an intricate decorative sheet.

Figure 15:
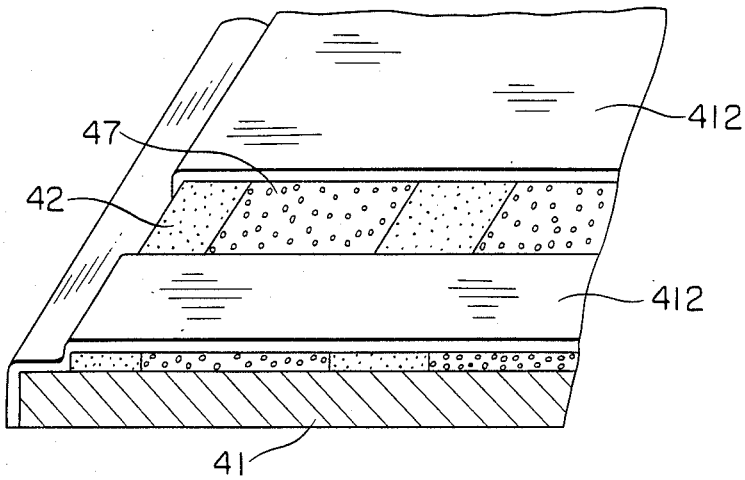
FIG. 15 is a partially broken perspective sectional view showing a state in which a third mask partially overlaps the first and second flame-sprayed layers on the plate.
Figure 16:
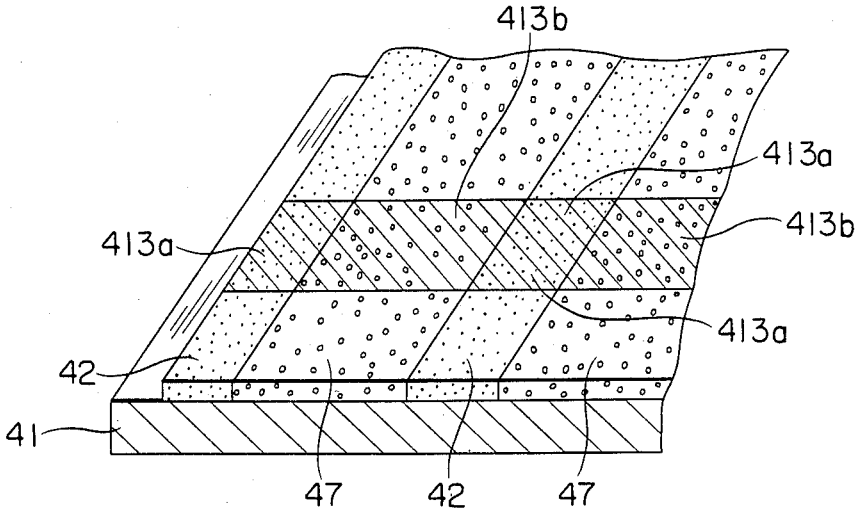
FIG. 16 is a partially broken perspective sectional view of a decorative sheet manufactured by the processing shown in FIG. 15.

FIGS. 15 to 16 show an embodiment in which a third coating layer is formed on the surfaces of the first and second coating layers 42 and 47, respectively. A third mask 412 completely covers the surface of the metallic plate 41 and partially covers the surfaces of the first and second coating layers 42 and 47, respectively. Then, as shown in FIG. 16, a color development treatment is performed on the exposed surfaces of the first and second coating layers 42 and 47 to form respective color developed portions 413*a* and 413*b* having colors different from each other. The color development treatment is a treatment of an oxidation or reduction reaction by various kinds of solutions such as potassium oxide, antimony pentasulfide, sulfuric acid and chromic acid.

In this third embodiment, a decorative sheet is formed with a plurality of coating materials and has an intricate pattern and high quality.

Figure 17:
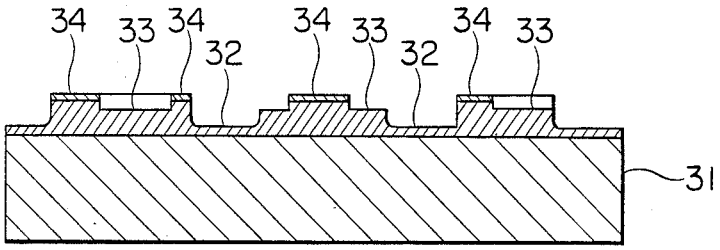
FIG. 17 is a cross-sectional view of a decorative sheet manufactured according to a fourth embodiment of the present invention.
Figure 18:
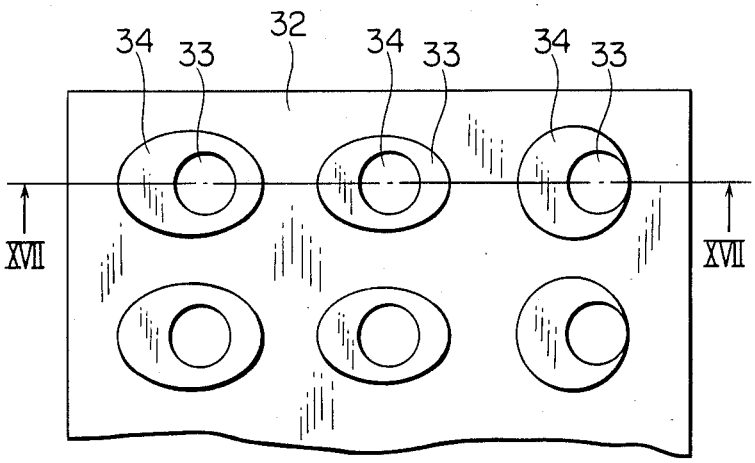
FIG. 18 is a plan view of the decorative sheet of FIG. 17 in which the cross-section of FIG. 17 is taken along Line XVII—XVII.

FIGS. 17 and 18 show a decorative sheet manufactured according to a fourth embodiment of the present invention. A metallic plate 31 of 1.5 mm×1200 mm×2500 mm for example is preferably made of steel. A flame-sprayed basic layer 32 is formed by flame-spraying a molten coating material preferably made of stainless steel onto the surface of the metallic plate 31. Each of flame-sprayed pattern layers 33 are formed by flame-spraying a coating material preferably made of stainless steel onto the surface of the basic layer 32. Each of frosted layers 34 is formed by a delustering hairline process forming a hairline pattern on the uppermost surface of each pattern layer 33.

When a decorative sheet is manufactured according to the fourth embodiment, the surface of the metallic plate 31 is treated in advance for the flame-spraying of a coating material. Then a coating material made of molten stainless steel is flame-sprayed onto the entire surface of the metallic plate 31 once or twice by a flame-spray gun to form a basic layer 32 whose thickness is preferably about 0.1 to 0.4 mm. Next, the basic layer 32 is covered with a mask with openings forming a pattern, and a coating material made of molten stainless steel is flame-sprayed onto the surface of the basic layer 32 through each opening of the mask, thereby forming pattern layers 33. The pattern layers 33 may be formed by exchanging masks more than once and laminating a plurality of flame-sprayed layers in accordance with the intricacy of the pattern. Furthermore, if necessary, the pattern layers can be made of materials different from each other to provide a more decorative appearance. After each pattern layer 33 has been formed on the basic layer 32, the hairline roughening process is performed on the uppermost surface of the pattern layer 33 to form frosted layers 34. Thus there can be obtained a gorgeous decorative sheet with an intricate pattern having recessed and projected portions.

In the fourth embodiment, the preferable coating materials are made of stainless steel which does not rust and has a high hardness. However, the coating materials are not limited to stainless steel, but other materials such as other metals, ceramics and glass may be used.

In the third and fourth embodiments, etching is not used to manufacture a decorative sheet so that there are no disadvantages caused by the etching process. Furthermore, no pollution is generated and a pattern on the decorative sheet can be formed in a short period of time.

Since the decorative sheet is formed by the flame-spraying of coating materials, the decorative sheet can be manufactured relatively cheaply in comparison with conventional sheets in which thick and expensive materials for base plates are used to only barely treat the surfaces thereof. Furthermore, in comparison with embossing, the depths of the recessed and projected portions of the pattern on the surface of the decorative sheet are sufficiently large so that a distinct pattern is formed on the sheet. Furthermore, a decorative sheet according to the present invention meets the basic conditions for such decorative sheets in which the sheet does not rust, is not easily damaged and will not burn. In addition, the flame-sprayed layers of the coating materials can be uniformly formed by a robot.

The present invention is applied to a flat plate but can also be applied to a solid member such as a cylinder in which a pattern having recessed and projected portions is formed on the surface of the solid member. A decorative sheet manufactured according to the present invention is suitable for doors in an elevator.

What is claimed is:

1. A method for manufacturing a decorative sheet from a metallic sheet comprising the steps of:

etching the surface of the metallic sheet to form an etched pattern therein; and flame-spraying a material different from the material of the metallic sheet only on the etched pattern of the metallic sheet through a mask.

2. A method for manufacturing a decorative sheet from a metallic sheet as claimed in claim 1, wherein said flame-sprayed material is powder of one of brass, ceramic and glass.

3. A method for manufacturing a decorative sheet from a metallic sheet as claimed in claim 1, wherein the surface of the flame-sprayed layer in substantially the same level as the surface of the unetched portion of the metallic sheet.

4. A method for manufacturing a decorative sheet from a metallic sheet as claimed in claim 1, wherein the etched portion of the metallic sheet is set to be of a predetermined depth such that the etched portion of the metallic sheet is not exposed even when the surface of the flame-sprayed layer is damaged.

5. A method for manufacturing a decorative sheet from a metallic sheet as claimed in claim 1, wherein the outside surface of the flame-sprayed layer is polished after the mask has been removed.

6. A method for manufacturing a decorative sheet from a metallic sheet as claimed in claim 1, wherein the mask is made of a heat resistant material.

7. A method for manufacturing a decorative sheet from a metallic sheet as claimed in claim 1, wherein said flame-sprayed material is a mixture of different coating materials.

8. A method for manufacturing a decorative sheet from a metallic sheet as claimed in claim 7, wherein said flame-sprayed material is a mixture of aluminum and brass.

9. A method for manufacturing a decorative sheet from a metallic sheet as claimed in claim 7, wherein said flame-sprayed material is a mixture of aluminum and resin.

10. A method for manufacturing a decorative sheet from a metallic sheet comprising the steps of:

selectively flame-spraying a first coating material onto the surface of the metallic sheet through a first mask to form a pattern of a first coating layer; and flame-spraying a second coating material onto at least a portion of the uncoated surface of the metallic sheet which is not coated by the first coating layer through a second mask to form a second pattern of a second coating layer; and selectively performing a color development treatment on the first and second coating layers through a third mask so as to form color developed portions on the first and second coating layers.

11. A method for manufacturing a decorative sheet from a metallic sheet as claimed in claim 10, wherein said color development treatment of the exposed portions is performed by an oxidation or reduction reaction of the exposed portions.

* * * * *